US009431194B2

(12) United States Patent
Lim

(10) Patent No.: US 9,431,194 B2
(45) Date of Patent: Aug. 30, 2016

(54) SUPPORTING STRUCTURE OF CLOSING RESISTOR FOR HIGH VOLTAGE CIRCUIT BREAKER

(71) Applicant: LSIS CO., LTD., Anyang-si, Gyeonggi-do (KR)

(72) Inventor: Woo Seung Lim, Busan (KR)

(73) Assignee: LSIS CO., LTD., Anyang-si (KR)

( * ) Notice: Subject to any disclaimer, the term of this patent is extended or adjusted under 35 U.S.C. 154(b) by 0 days.

(21) Appl. No.: 14/804,158

(22) Filed: Jul. 20, 2015

(65) Prior Publication Data

US 2016/0118208 A1 Apr. 28, 2016

(30) Foreign Application Priority Data

Oct. 23, 2014 (KR) ..... 10-2014-0144385

(51) Int. Cl.
*H01H 31/02* (2006.01)
*H01H 33/16* (2006.01)

(52) U.S. Cl.
CPC ..... *H01H 31/02* (2013.01); *H01H 33/166* (2013.01)

(58) Field of Classification Search
CPC ..... H01H 2071/008; H01H 59/0009; H01H 9/541; H01H 2071/044; H01H 9/563; H01H 33/593; H01H 71/123; H01H 73/045; H01H 9/542; H01H 1/0036; H01H 2003/266; H01H 2083/201; H01H 33/022; H01H 3/26
See application file for complete search history.

(56) References Cited

U.S. PATENT DOCUMENTS 4,293,749 A * 10/1981 Kishi ..... H01H 33/166 218/143
4,442,330 A * 4/1984 Oshita ..... H01H 33/91 218/143

(Continued)

FOREIGN PATENT DOCUMENTS

EP 0050826 5/1982
KR 10-0606423 8/2006

OTHER PUBLICATIONS

European Patent Office Application Serial No. 15181377.1, Search Report dated Mar. 18, 2016, 5 pages.

*Primary Examiner* — Truc Nguyen
(74) *Attorney, Agent, or Firm* — Lee, Hong, Degerman, Kang & Waimey; Jonathan Kang; Harry Lee

(57) ABSTRACT

The present invention relates to a supporting structure of a closing resistor for a high voltage circuit breaker, capable of stably supporting the closing resistor not to be twisted even by an impact applied upon a closing operation. A supporting structure of a closing resistor for a high voltage circuit breaker according to one embodiment includes a fixed part main circuit conductor, a supporting conductor installed on an upper surface of the fixed part main circuit conductor, a connecting conductor connected to one end of the supporting conductor, a closing resistor unit coupled to one side of the fixed part main circuit conductor in a spaced manner, and a coupling conductor provided to couple the supporting conductor to the closing resistor unit. The supporting conductor and the connecting conductor are provided with a coupling rib and a coupling groove, respectively, to be coupled to each other in an inserting manner.

8 Claims, 6 Drawing Sheets

(56) References Cited

U.S. PATENT DOCUMENTS 4,454,394 A * 6/1984 Toyoda ..... H01H 33/166 218/6
4,500,762 A * 2/1985 Yoshizumi ..... H01H 33/24 218/12
5,264,671 A * 11/1993 Pham ..... H01H 33/168 218/144
5,298,703 A * 3/1994 Yatsuzuka ..... H01H 33/022 218/44
5,354,959 A * 10/1994 Yoshizumi ..... H01H 33/34 218/84
5,451,731 A * 9/1995 Yoshizumi ..... H01H 33/168 218/143
5,567,924 A * 10/1996 Yano ..... H01H 33/166 218/143
5,734,140 A * 3/1998 Hokuto ..... H02B 13/0356 218/143
5,814,782 A * 9/1998 Muller ..... H01H 33/166 218/143
5,841,614 A * 11/1998 Perret ..... H01H 33/166 218/143

* cited by examiner

SUPPORTING STRUCTURE OF CLOSING RESISTOR FOR HIGH VOLTAGE CIRCUIT BREAKER

CROSS-REFERENCE TO RELATED APPLICATION

Pursuant to 35 U.S.C. § 119(a), this application claims the benefit of earlier filing date and right of priority to Korean Patent Application No. 10-2014-0144385, filed on Oct. 23, 2014, the contents of which is hereby incorporated by reference herein in its entirety.

BACKGROUND OF THE DISCLOSURE

1. Field of the Disclosure

This specification relates to a supporting structure of a closing resistor for a high voltage circuit breaker, and more particularly, a supporting structure of a closing resistor for a high voltage circuit breaker, capable of stably supporting the closing resistor of the high voltage circuit breaker such that the closing resistor cannot be twisted even by an impact applied upon a closing operation.

2. Background of the Disclosure

In general, a high voltage circuit breaker (for example, a gas-insulated switchgear) is an electric device which is installed on a circuit between a power source side and a load side of an electric power system to forcibly open and close the circuit in a normal current-flowing state or safely breaking a current upon an occurrence of a fault current, such as ground fault or short-circuit, on the circuit. The high voltage circuit breaker is generally used for high voltage equipment.

The high voltage circuit breaker is provided with various additional components. For example, a capacitor or a closing resistor is installed to reduce steep-increasing of voltage which is generated upon a closing operation.

FIGS. 1 and 2 illustrate the invention disclosed in Korean Registration Patent No. 10-0606423 titled "Contacting structure of closing resistor contacts for gas-insulated switchgear." FIG. 1 illustrates a configuration of a circuit breaker of the related art gas-insulated switchgear, and FIG. 2 is an enlarged view of part 'A' of FIG. 1, which illustrates an open state of the closing resistor.

As illustrated in FIGS. 1 and 2, a circuit breaker A of high voltage equipment is divided into a moving part 1 and a fixed part 2, each of which is separately assembled and fixed in an enclosure (tank) 5. A closing resistor 4 is provided at one side of the fixed part 2, and a closing resistor moving unit 3 is provided at one side of the moving part 1.

In the circuit breaker A, it is important that the centers of the moving part 1 and the fixed part 2 are located on the same straight line so as to be brought into contact with or separated from each other. However, various additional components attached make it difficult to maintain such linear motion when a rated voltage increases more.

Also, when the rate voltage increases more, driving force of a driving unit for breaking the circuit becomes stronger, which may cause more impacts to be applied to the fixed part 2 upon closing the circuit breaker. Furthermore, the closing resistor 4 and the closing resistor moving unit 3 directly collide with each other without sliding, which causes great impact resistance. Accordingly, the moving part 1 may be twisted due to its rotation or a coupling force of the fixed part 2 may be lowered.

SUMMARY OF THE DISCLOSURE

Therefore, to obviate the related art problems, an aspect of the detailed description is to provide a supporting structure of a closing resistor for a high voltage circuit breaker, capable of providing resistance to a torsional moment upon a closing operation by increasing supporting force between a closing resistor and a fixed part of the circuit breaker, and of preventing a coupled state between the closing resistor and the fixed part from being weakened.

To achieve these and other advantages and in accordance with the purpose of this specification, as embodied and broadly described herein, there is provided a supporting structure of a closing resistor for a high voltage circuit breaker, the structure including a fixed part main circuit conductor, a supporting conductor installed on an upper surface of the fixed part main circuit conductor, a connecting conductor connected to one end of the supporting conductor, a closing resistor unit coupled to one side of the fixed part main circuit conductor with being spaced apart therefrom, and a coupling conductor provided to couple the supporting conductor and the closing resistor unit to each other, wherein the supporting conductor and the connecting conductor are provided with a coupling rib and a coupling groove, respectively, to be coupled to each other in an inserting manner.

Here, the closing resistor unit may be coupled to the fixed part main circuit conductor by a vertical insulating support plate.

The supporting structure may further include a horizontal insulating support plate installed with being spaced apart from the vertical insulating support plate and configured to connect the fixed part main circuit conductor and the closing resistor unit to each other.

The vertical insulating support plate may be provided in plurality.

A circumferential coupling portion may protrude from an outer circumferential surface of the fixed part main circuit conductor, and the vertical insulating support plate may be coupled to the circumferential coupling portion.

The coupling rib may be formed long in a vertical direction of the supporting conductor and the coupling groove may be formed in a form of a slot in a vertical direction of the connecting conductor, so as to be resistant to twisted moment generated centering on the connecting conductor as a shaft.

The coupling conductor may be coupled to the supporting conductor and the closing resistor unit by screws.

An annular insulating support plate may be inserted to a part of the closing resistor unit, wherein one side of the coupling conductor is coupled to a mounting portion of the supporting conductor, and the other side of the coupling conductor is coupled to the annular insulating support plate.

A supporting structure of a closing resistor for a high voltage circuit breaker may be implemented as a multi-point supporting structure including both a support by a vertical insulating support plate, an annular insulating support plate, a horizontal insulating support plate and a coupling conductor, and a support by a coupling rib and a coupling groove between a supporting conductor and the connecting conductor. This may result in generating stable resistance to twisted moment.

Therefore, it may be possible to prevent the twisted moment which may be generated due to an eccentric center of gravity, which is caused by a closing resistor unit installed at one side of a fixed part main circuit conductor in the spaced manner.

Also, a loose screw between the supporting conductor and the connecting conductor, which may be caused due to an impact applied by repetitive opening and closing operations, can be prevented.

Further scope of applicability of the present application will become more apparent from the detailed description given hereinafter. However, it should be understood that the detailed description and specific examples, while indicating preferred embodiments of the disclosure, are given by way of illustration only, since various changes and modifications within the spirit and scope of the disclosure will become apparent to those skilled in the art from the detailed description.

BRIEF DESCRIPTION OF THE DRAWINGS

The accompanying drawings, which are included to provide a further understanding of the disclosure and are incorporated in and constitute a part of this specification, illustrate exemplary embodiments and together with the description serve to explain the principles of the disclosure.

In the drawings.

DETAILED DESCRIPTION OF THE DISCLOSURE

Description will now be given of preferred configurations of the present invention, with reference to the accompanying drawings. However, those preferred embodiments of the present invention are merely illustrative to help those skilled in the art easily practice the invention, but should not be construed to limit the technical scope of the present invention.

Figure 1:
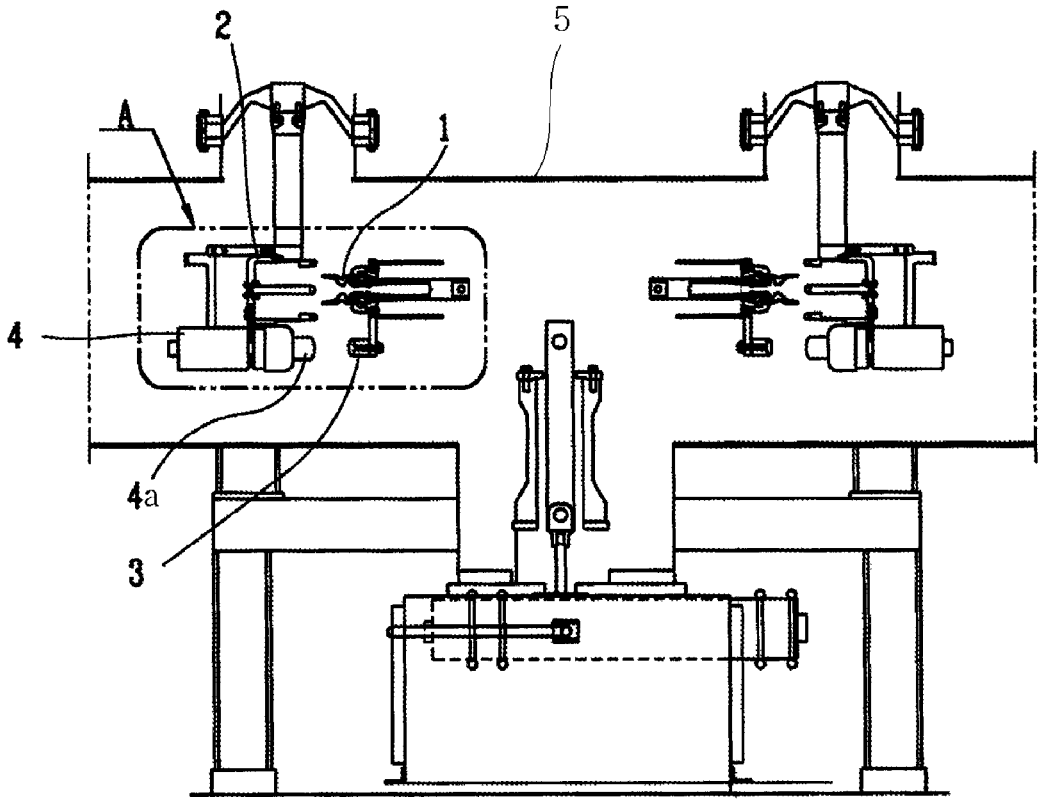
FIG. 1 Prior art
FIG. 1 is a lateral view illustrating a configuration of a circuit breaker of a gas-insulated switchgear according to the related art.
Figure 2:
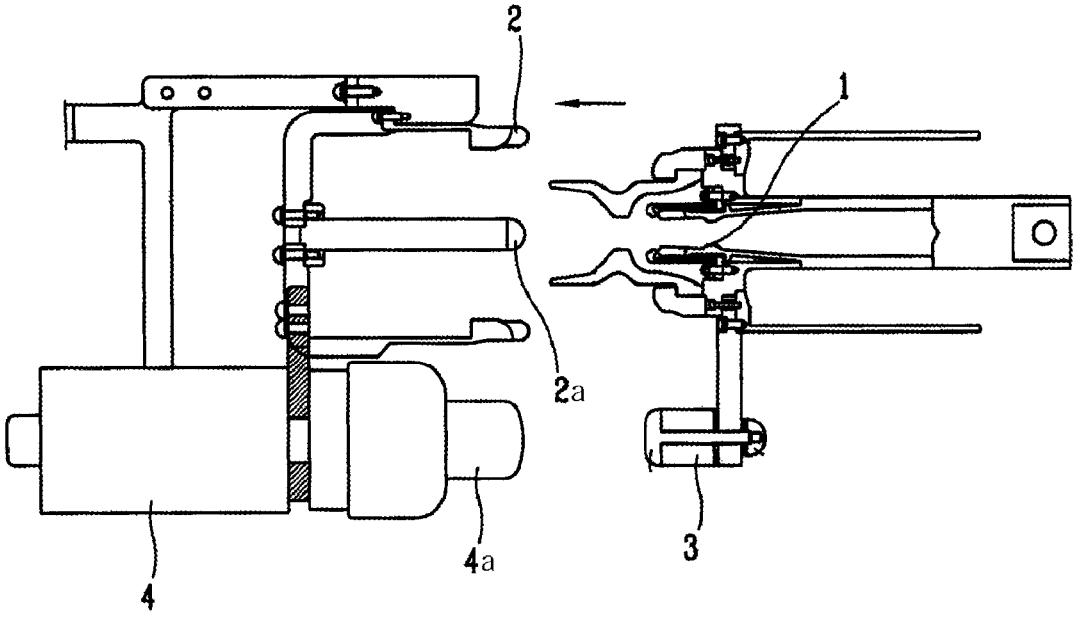
FIG. 2 Prior art
FIG. 2 is an enlarged view of part 'A' of FIG. 1, which illustrates an open state of a closing resistor.
Figure 3:
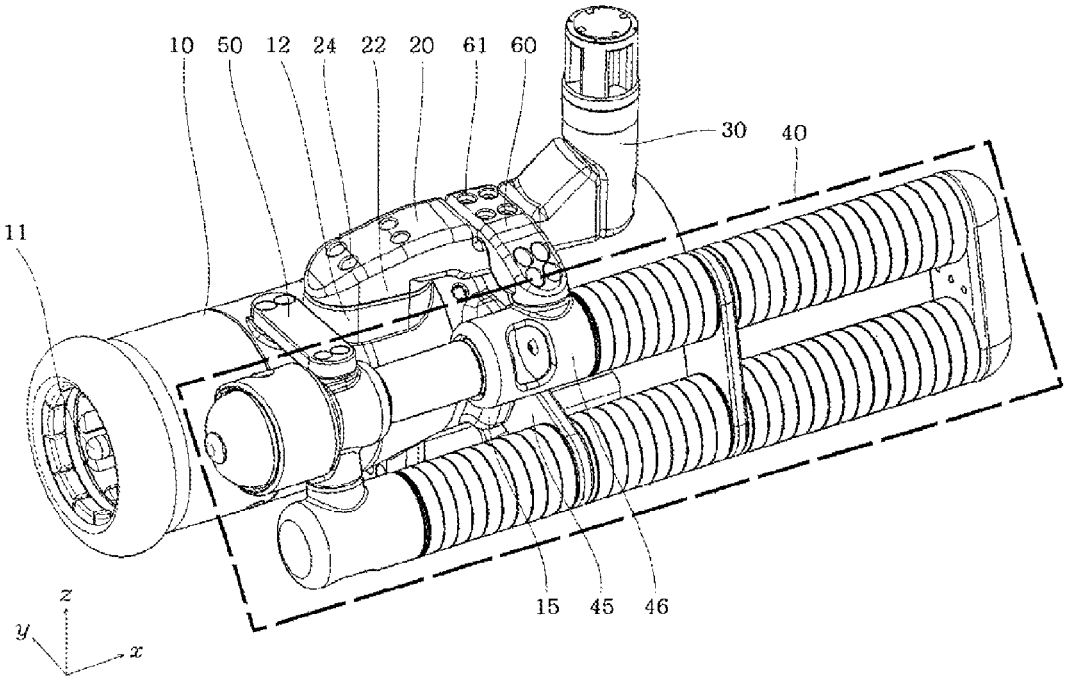
FIG. 3 is a perspective view of a supporting structure of a closing resistor for a high voltage circuit breaker in accordance with one exemplary embodiment of the present invention.
Figure 4:
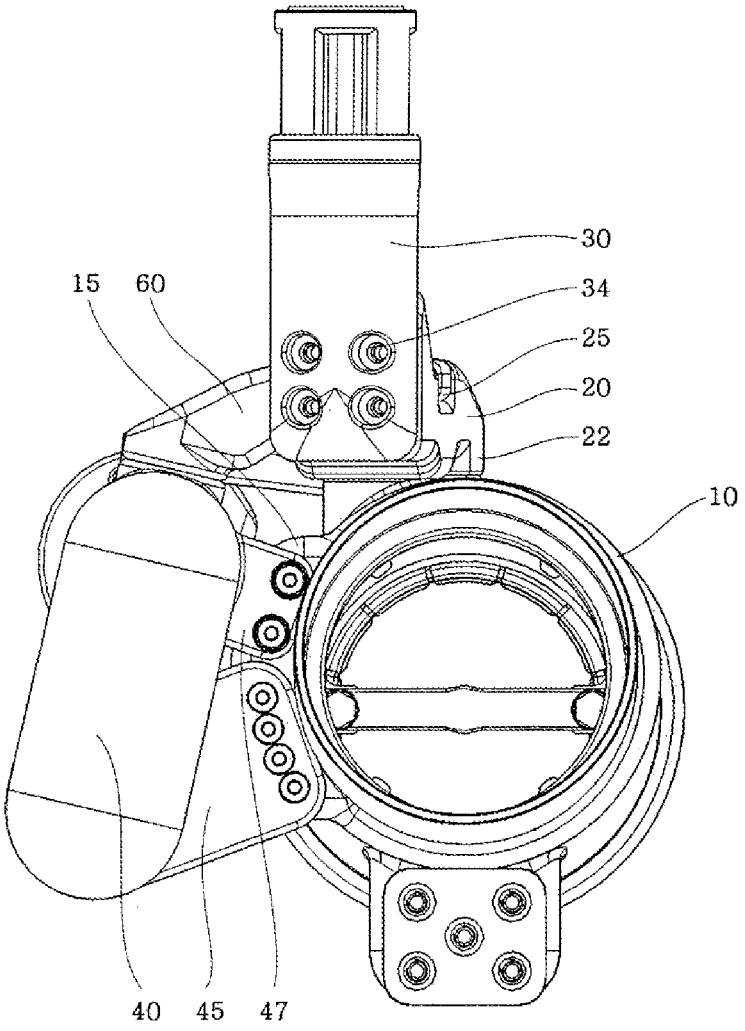
FIG. 4 is a rear view of the supporting structure of the closing resistor for the high voltage circuit breaker in accordance with the one exemplary embodiment of the present invention.
Figure 5:
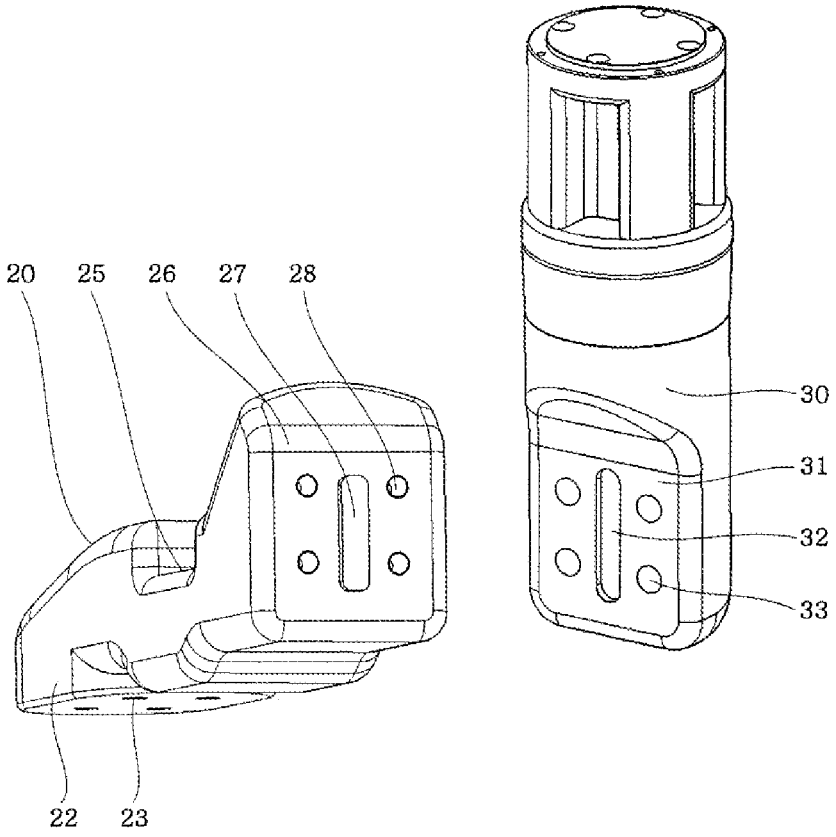
FIG. 5 is an exploded perspective view of a supporting conductor and a connecting conductor illustrated in FIG. 3.

FIG. 3 is a perspective view of a supporting structure of a closing resistor for a high voltage circuit breaker in accordance with one exemplary embodiment of the present invention, and FIG. 4 is a rear view of the supporting structure of the closing resistor for the high voltage circuit breaker in accordance with the one exemplary embodiment of the present invention. FIG. 5 is an exploded perspective view of a supporting conductor and a connecting conductor illustrated in FIG. 3. Hereinafter, description will be given in detail of a supporting structure of a closing resistor for a high voltage circuit breaker in accordance with each embodiment of the present invention, with reference to the accompanying drawings.

A supporting structure of a closing resistor for a high voltage circuit breaker may include a fixed part main circuit conductor 10, a supporting conductor 20 provided on an upper surface of the fixed part main circuit conductor 10, a connecting conductor 30 connected to one end of the supporting conductor 20, a closing resistor unit 40 coupled to one side of the fixed part main circuit conductor 10 with being spaced apart therefrom, and a coupling conductor 60 to couple the supporting conductor 20 and the closing resistor unit 40 to each other. The supporting conductor 20 and the connecting conductor 30 are provided with a coupling rib 27 and a coupling groove 32, respectively, so as to be coupled to each other in an inserting manner.

The fixed part main circuit conductor 10 defines a body of the fixed part of the circuit breaker.

A fixed arc contactor 11 is provided on a front surface of the fixed part main circuit conductor 10 to generate arc when coming in contact with a moving part (not illustrated).

The supporting conductor 20 is coupled to an upper surface of the fixed part main circuit conductor 10. A supporting base 12 is provided on the upper surface of the fixed part main circuit conductor 10, and a lower coupling portion 22 which is coupled to the supporting base 12 is provided on one side of the supporting conductor 20. The supporting base 12 and the lower coupling portion 22 may protrude from the upper surface of the fixed part main circuit conductor 10 and a lower surface of the supporting conductor 10, respectively. Surfaces of the supporting base 12 and the lower coupling portion 22 which are coupled to each other may be planar.

The supporting conductor 20 may be coupled to the fixed part main circuit conductor 10 by screws. To this end, a plurality of screw holes 23 may be formed at the lower coupling portion 22, and operation grooves 24 for insertion of screws may be formed on the lower coupling portion 22.

A mounting portion 25 to which the coupling conductor 60 is mounted is formed at a central portion of the supporting conductor 20. The mounting portion 25 may be formed in a shape of a recess crossing the central portion of the supporting conductor 20.

A side coupling portion 26 is disposed on the other side of the supporting conductor 20. The side coupling portion 26 is brought into contact with a coupling portion 31 of the connecting conductor 30. The coupling rib 27 is provided on the side coupling portion 26. The coupling rib 27 may be formed long along a vertical direction of the side coupling portion 26. A plurality of screw holes 28 may be formed near the coupling rib 27.

The connecting conductor 30 is coupled to the other side of the supporting conductor 20. The coupling portion 31 is located on a lower portion of the connecting conductor 30. The coupling groove 32 in which the coupling rib 27 of the supporting conductor 20 is insertable is formed on the coupling portion 31. The coupling groove 32 may be formed in a shape of a slot along a vertical direction of the coupling portion 31. As the coupling rib 27 and the coupling groove 32 are formed long, when the supporting conductor 20 and the connecting conductor 30 are coupled to each other, a yaw effect is not generated in the supporting member 20 and the connecting conductor 30. That is, the supporting conductor 20 may have increased resistance with respect to torsional moment which is generated centering on the connecting conductor 30 as a shaft. Therefore, the supporting conductor 20 can be prevented from being twisted.

The coupling portion 31 is provided with a plurality of screw holes 32 which communicate with the screw holes 28 of the side coupling portion 26 of the supporting conductor 20. Operation grooves 34 for insertion of screws are formed on a rear side of the coupling portion 31.

The supporting conductor 20 and the connecting conductor 30 are supported by high supporting force resulting from the screw coupling and rib coupling, The closing resistor unit 40 is installed at a side surface of the fixed part main circuit conductor 10 with being spaced apart therefrom. A vertical insulating support plate 45 is disposed to couple the closing resistor unit 40 to the fixed part main circuit conductor 10. The vertical insulating support plate 45 is formed in a shape of a plate vertical to an axial direction of the fixed part main circuit conductor 10. The vertical insulating support plate 45 may be provided in plurality for stable support of the closing resistor unit 40.

A circumferential coupling portion 15 to which the vertical insulating support plate 45 can be coupled may protrude from an outer circumferential surface of the fixed part main circuit conductor 10. The vertical insulating support plate 45 may be coupled to the circumferential coupling portion 15 by screws.

To fixedly support the fixed part main circuit conductor 10 and the closing resistor unit 40, a horizontal insulating support plate 50 may be installed with being spaced apart from the vertical insulating support plate 45. The horizontal insulating support plate 45 may be located at one side of the supporting conductor 20 on the fixed part main circuit conductor 10. Referring to FIG. 3, the horizontal insulating support plate 50 is installed with being spaced from the vertical insulating support plate 45 in x, y and z-axial directions. Accordingly, the closing resistor unit 40 is stably supported on the fixed part main circuit conductor 10, so as to have resistance to forces in the x, y and z-axial directions and the torsional moment centering on the x, y and z-axial directions.

An annular insulating support plate 46 may be provided on a part of the closing resistor unit 40. The annular insulating support plate 46 may be coupled in a manner of being inserted to the part of the closing resistor unit 40. A vertical plate 47 may protrude from a part of the annular insulating support plate 46 toward the fixed part main circuit conductor 10 so as to be coupled to the fixed part main circuit conductor 10. The annular insulating support plate 46 supports the coupling conductor 60.

The coupling conductor 60 is provided to couple the supporting conductor 20 and the closing resistor unit 40 to each other. One side of the coupling conductor 60 is coupled to the mounting portion 35 of the supporting conductor 20, and the other side of the coupling conductor 60 is coupled to the annular insulating support plate 46. Operation grooves 61 are provided on the coupling conductor 60 to couple the coupling conductor 60 to the supporting conductor 20 and the annular insulating support plate 46. The coupling conductor 60 also serves to apply supporting force between the supporting conductor 20 and the closing resistor unit 40.

The closing resistor unit 40 is coupled to the fixed part main circuit conductor 10 in the spaced manner while being stably supported by the vertical insulating support plate 45, the horizontal insulating support plate 50, the coupling conductor 60 and the annular insulating support plate 46.

In detail, the vertical insulating support plate 45 and the horizontal insulating support plate 50 are installed at positions spaced apart from each other along a lengthwise direction of the fixed part main circuit conductor 10, thereby having resistance to torsional moment centering on the y and x-axial directions.

Also, the coupling conductor 60 and the vertical insulating support plate 45 are installed at positions spaced apart from each other along a horizontal direction of the fixed part main circuit conductor 10, thereby having resistance to torsional moment centering on the y and z-axial directions.

Consequently, by a triangular supporting structure of the vertical insulating support plate 45, the horizontal insulating support plate 50 and the coupling conductor 60, the closing resistor unit 40 can remain stable without being twisted from the fixed part main circuit conductor 10 upon an impact applied during a closing operation.

Figure 6:
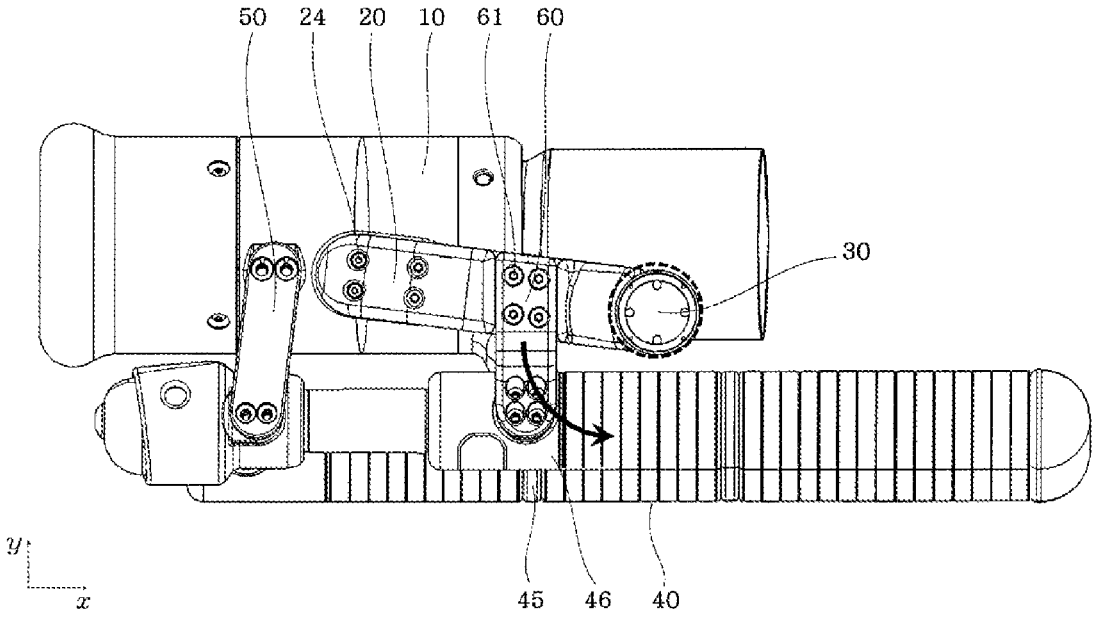
FIG. 6 is a planar view illustrating an operating state of the supporting structure of the closing resistor for the high voltage circuit breaker in accordance with the one exemplary embodiment of the present invention.

In addition, the connecting conductor 30 and the supporting conductor 20 coupled to each other can stably be supported without being twisted as the coupling rib 27 is inserted into the coupling groove 32. Referring to FIG. 6, a moment of rotating (twisting) in a counterclockwise direction centering on the connecting conductor 30 is generated due to an impact which is applied when closing the moving part. The supporting structure according to the one embodiment of the present invention is implemented as a multipoint supporting structure including both the support by the vertical insulating support plate 45, the annular insulating support plate 46, the horizontal insulating support plate 50 and the coupling conductor 60, and the support by the coupling rib 27 and the coupling groove 32 between the supporting conductor 20 and the connecting conductor 30. This may result in generating stable resistance to such twisted moment.

Therefore, it may be possible to prevent the twisted moment which is likely to be generated due to an eccentric center of gravity, which is caused by the closing resistor unit 40 installed at one side of the fixed part main circuit conductor 10 in the spaced manner.

Also, a loose screw between the supporting conductor 20 and the connecting conductor 30, which may be caused due to an impact applied by repetitive opening and closing operations, can be prevented.

As the present features may be embodied in several forms without departing from the characteristics thereof, it should also be understood that the above-described embodiments are not limited by any of the details of the foregoing description, unless otherwise specified, but rather should be construed broadly within its scope as defined in the appended claims, and therefore all changes and modifications that fall within the metes and bounds of the claims, or equivalents of such metes and bounds are therefore intended to be embraced by the appended claims.

What is claimed is:

1. A supporting structure of a closing resistor for a high voltage circuit breaker, the structure comprising:

a fixed part main circuit conductor;

a supporting conductor installed on an upper surface of the fixed part main circuit conductor;

a connecting conductor connected to one end of the supporting conductor;

a closing resistor unit coupled to one side of the fixed part main circuit conductor; and a coupling conductor provided to couple the supporting conductor and the closing resistor unit to each other, wherein the supporting conductor and the connecting conductor are provided with a coupling rib and a coupling groove, respectively, to be coupled to each other in an inserting manner.

2. The supporting structure of claim 1, wherein the closing resistor unit is coupled to the fixed part main circuit conductor by a vertical insulating support plate.

3. The supporting structure of claim 2, further comprising a horizontal insulating support plate installed with being spaced apart from the vertical insulating support plate and configured to connect the fixed part main circuit conductor and the closing resistor unit to each other.

4. The supporting structure of claim 2, wherein the vertical insulating support plate is provided in plurality.

5. The supporting structure of claim 2, wherein a circumferential coupling portion protrudes from an outer circumferential surface of the fixed part main circuit conductor, the vertical insulating support plate being coupled to the circumferential coupling portion.

6. The supporting structure of claim 1, wherein the coupling rib is formed long in a vertical direction of the supporting conductor and the coupling groove is formed in a form of a slot in a vertical direction of the connecting conductor, so as to be resistant to twisted moment generated centering on the connecting conductor as a shaft.

7. The supporting structure of claim 1, wherein the coupling conductor is coupled to the supporting conductor and the closing resistor unit by screws.

8. The supporting structure of claim 1, wherein an annular insulating support plate is inserted to a part of the closing resistor unit, wherein one side of the coupling conductor is coupled to a mounting portion of the supporting conductor, and the other side of the coupling conductor is coupled to the annular insulating support plate.

* * * * *